US011512698B2

(12) United States Patent
Iimura

(10) Patent No.: US 11,512,698 B2
(45) Date of Patent: Nov. 29, 2022

(54) ELECTRIC OIL PUMP APPARATUS

(71) Applicant: JTEKT CORPORATION, Osaka (JP)

(72) Inventor: Daisuke Iimura, Anjo (JP)

(73) Assignee: JTEKT CORPORATION, Kariya (JP)

( * ) Notice: Subject to any disclaimer, the term of this patent is extended or adjusted under 35 U.S.C. 154(b) by 0 days.

(21) Appl. No.: 17/072,739

(22) Filed: Oct. 16, 2020

(65) Prior Publication Data

US 2021/0123439 A1 Apr. 29, 2021

(30) Foreign Application Priority Data

Oct. 23, 2019 (JP) ..... JP2019-192408

(51) Int. Cl.
*F04C 15/00* (2006.01)

(52) U.S. Cl.
CPC ..... *F04C 15/008* (2013.01); *F04C 2210/206* (2013.01); *F04C 2240/50* (2013.01)

(58) Field of Classification Search
CPC ..... F04C 15/008; F04C 2210/206; F04C 2240/50
See application file for complete search history.

(56) References Cited

U.S. PATENT DOCUMENTS 3,606,601 A * 9/1971 White, Jr. et al. ..... F04C 2/104 418/61.3
9,441,678 B2 * 9/2016 Nelson ..... F16D 9/06
2013/0052058 A1 * 2/2013 Motohashi ..... F01C 21/02 417/410.4
2013/0206087 A1 * 8/2013 Tadokoro ..... F01L 1/352 123/90.15
2017/0167491 A1 * 6/2017 Reul ..... F04D 29/586

FOREIGN PATENT DOCUMENTS

GB 1035226 * 7/1966
JP 2019-120214 A 7/2019

* cited by examiner

*Primary Examiner* — Connor J Tremarche
(74) *Attorney, Agent, or Firm* — Oblon, McClelland, Maier & Neustadt, L.L.P.

(57) ABSTRACT

An electric oil pump apparatus includes a housing, an electric motor, an oil pump, a shaft, a first bearing, and a second bearing. The electric motor is housed in the housing. The oil pump is provided in the housing and positioned on a first side in an axial direction with respect to the electric motor so as to be adjacent to the electric motor, and includes a pump rotational element rotatable coaxially with a motor rotor. The motor rotor and the pump rotational element are fitted to the shaft to be rotatable together with the shaft. The first bearing is disposed on the first side with respect to the pump rotational element, and supports the shaft while allowing rotation relative to the housing. The second bearing is disposed on a second side with respect to the pump rotational element, and supports the shaft while allowing rotation relative to the housing.

7 Claims, 1 Drawing Sheet

ELECTRIC OIL PUMP APPARATUS

CROSS-REFERENCE TO RELATED APPLICATION

This application claims priority to Japanese Patent Application No. 2019-192408 filed on Oct. 23, 2019, incorporated herein by reference in its entirety.

BACKGROUND

1. Technical Field

The disclosure relates to an electric oil pump apparatus.

2. Description of Related Art

Japanese Unexamined Patent Application Publication No. 2019-120214 (JP 2019-120214 A) describes an electric oil pump apparatus including an electric motor and an oil pump. In the electric oil pump apparatus, a shaft for transmitting a rotational force between a motor rotor of the electric motor and a pump rotational element of the oil pump is supported by a bearing so as to be rotatable relative to a housing. The bearing is disposed at a center in an axial direction of the shaft.

SUMMARY

The oil pump has a high-pressure area and a low-pressure area in its circumferential direction. Therefore, a tilting force (radial force) is applied to the shaft due to oil in the high-pressure area. In the related-art electric oil pump apparatus in which the bearing that supports the shaft is disposed only at the center in the axial direction of the shaft, the shaft may be tilted by action of the high-pressure oil.

When the shaft is tilted at the oil pump, the pump rotational element fixed to the shaft (such as an inner rotor of an internal gear pump) is tilted. As a result, the state of pump chambers deviates from a desired state. Then, the pump performance may decrease. Further, the pump rotational element of the oil pump may be worn out when the pump rotational element is tilted due to the tilting of the shaft. As a result, the durability of the oil pump may decrease.

The disclosure provides an electric oil pump apparatus in which pump performance and pump durability can be improved.

An electric oil pump apparatus according to one aspect of the disclosure includes a housing; an electric motor housed in the housing and including a motor stator and a motor rotor; an oil pump provided in the housing at a position on a first side in an axial direction with respect to a position of the electric motor so as to be adjacent to the electric motor, the oil pump including a pump rotational element that is rotatable coaxially with the motor rotor; a shaft to which the motor rotor and the pump rotational element are fitted such that the motor rotor and the pump rotational element are rotatable together with the shaft; a first bearing disposed on the first side in the axial direction with respect to a position of the pump rotational element, the first bearing supporting the shaft while allowing rotation of the shaft relative to the housing; and a second bearing disposed on a second side in the axial direction with respect to the position of the pump rotational element, the second side being opposite to the first side, and the second bearing supporting the shaft while allowing the rotation of the shaft relative to the housing.

With the electric oil pump apparatus, the shaft is supported on the housing by the first bearing and the second bearing on both sides in the axial direction with respect to the pump rotational element of the oil pump. Thus, even if a force is applied to the shaft due to high-pressure oil, tilting of the shaft can be restrained at the position of the oil pump. As a result, the pump performance and the pump durability can be improved.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

1. Overview of Electric Oil Pump Apparatus

For example, an electric oil pump apparatus is applied to a transmission of a vehicle (e.g., an automobile). The electric oil pump apparatus is also applicable to an apparatus other than the transmission of the vehicle. The electric oil pump apparatus includes an electric motor and an oil pump driven by the electric motor. The electric motor and the oil pump are provided in a housing such that a unit is formed. The electric motor and the oil pump are adjacent to each other in a rotation axis direction.

Both an inner-rotor electric motor and an outer-rotor electric motor are applicable to the electric motor. The oil pump includes a pump rotational element that is rotatable coaxially with a rotation axis of a motor rotor of the electric motor. A gear pump, a vane pump, and various other pumps are applicable to the oil pump. An example of the gear pump is an internal gear pump such as a trochoid pump. When the oil pump is the internal gear pump, an inner rotor corresponds to the pump rotational element. When the oil pump is the vane pump, a rotor that guides a vane in a radial direction in a slidable manner corresponds to the pump rotational element.

The electric oil pump apparatus includes a shaft configured to transmit a rotational force (torque) between the motor rotor of the electric motor and the pump rotational element of the oil pump. That is, the motor rotor and the pump rotational element are fitted to the shaft to be rotatable together with the shaft. The shaft is supported on the housing to be rotatable coaxially with the motor rotor and the pump rotational element.

The electric oil pump apparatus may include an integrated unit including a control board together with the electric motor and the oil pump. The control board may be omitted from the electric oil pump apparatus. That is, the control board may be disposed outside the unit of the electric oil pump apparatus.

2. Example of Structure of Electric Oil Pump Apparatus 1

Figure 1:
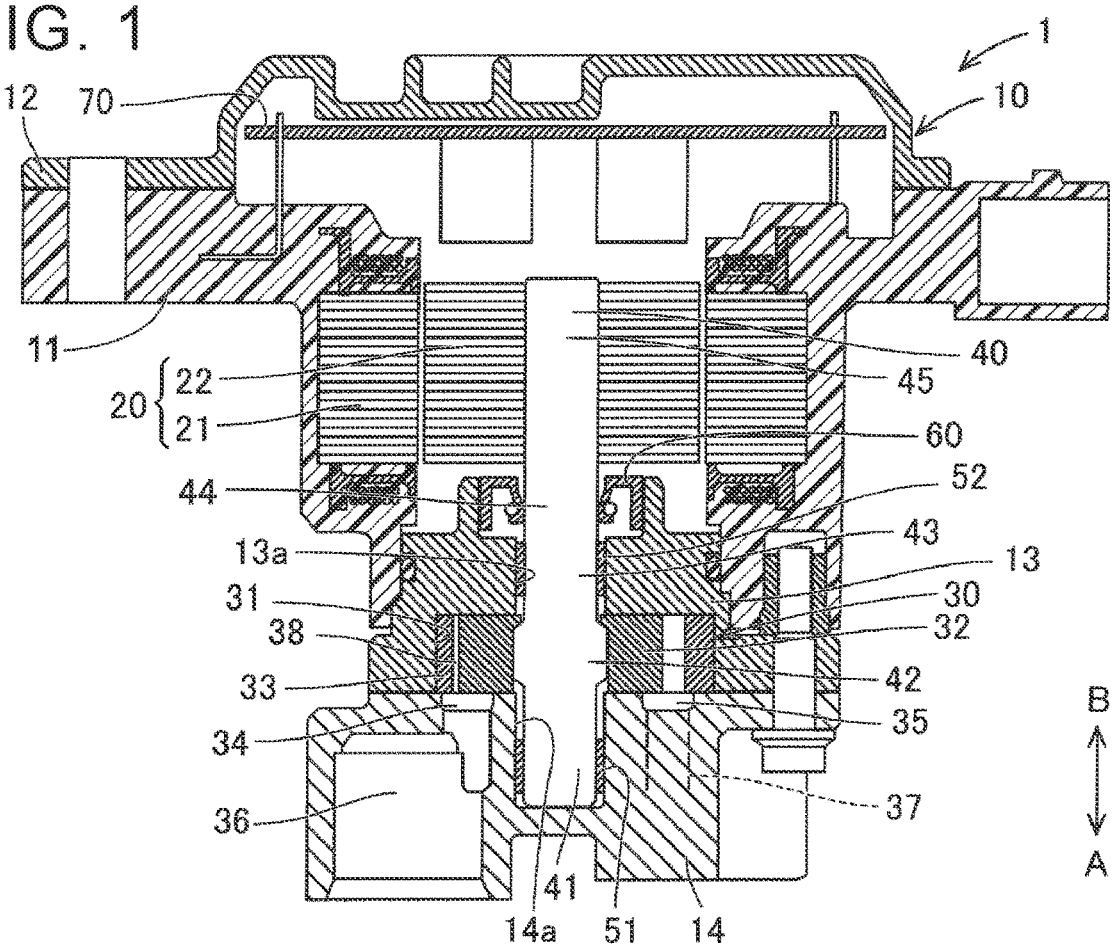
FIG. 1 is an axial sectional view of an electric oil pump apparatus.

An example of the structure of an electric oil pump apparatus 1 is described with reference to FIG. 1. As illustrated in FIG. 1, the electric oil pump apparatus 1 includes a housing 10, an electric motor 20, an oil pump 30, and a shaft 40. A lower side in FIG. 1 is referred to as "side A", which is a first side in a central axis direction of each of the electric motor 20 and the oil pump 30. An upper side in FIG. 1 is referred to as "side B", which is a second side in the central axis direction.

The housing 10 may be formed of an arbitrary number of members. In this example, the housing 10 is formed of four housing elements. In this example, the housing 10 includes motor housings 11 and 12 serving as a housing of the electric motor 20, and pump housings 13 and 14 serving as a housing of the oil pump 30. In this example, the motor housings 11 and 12 are provided separately from the pump housings 13 and 14, but a part of the motor housings 11 and 12 and a part of the pump housings 13 and 14 may form a single member.

For example, the first motor housing 11 is made of a resin. The first motor housing 11 has a tubular shape with a through-hole at a center thereof. The first motor housing 11 is open to both sides (side A and side B) in an axial direction. The first motor housing 11 mainly houses the electric motor 20. The first motor housing 11 includes a mounting flange extending radially outward, and a connector configured to establish connection to the outside.

The second motor housing 12 serves as a cover configured to close the opening of the first motor housing 11, the opening being located on the side B (upper side in FIG. 1). The second motor housing 12 is made of a metal such as aluminum. The second motor housing 12 is fastened integrally to the first motor housing 11 with bolts (not illustrated) or the like.

For example, the first pump housing 13 is made of a metal (such as aluminum) that can withstand high-pressure oil. The first pump housing 13 has a tubular shape with a through-hole at a center thereof. The first pump housing 13 is fixed integrally to (a portion defining) the opening of the first motor housing 11, the opening being located on the side A (lower side in FIG. 1). Specifically, a part of the first pump housing 13 in the axial direction is fitted to a portion of an inner peripheral surface of the first motor housing 11 via a sealing member (such as an O-ring), the portion of the inner peripheral surface being located on the side A.

The second pump housing 14 is made of a metal that can withstand high-pressure oil similarly to the first pump housing 13. The second pump housing 14 is fixed to a portion of the first pump housing 13, the portion of the first pump housing 13 being located on the side A (lower side in FIG. 1). In FIG. 1, both the first pump housing 13 and the second pump housing 14 are fastened to the first motor housing 11 with bolts.

The electric motor 20 is housed in the housing 10. In this example, the electric motor 20 is housed in the first motor housing 11. The electric motor 20 includes a motor stator 21 and a motor rotor 22. In this example, an inner-rotor electric motor is employed as the electric motor 20. Thus, the motor stator 21 is located on a radially outer side, and the motor rotor 22 is located on a radially inner side. That is, the motor stator 21 is fixed to an inner peripheral side of the first motor housing 11, and the motor rotor 22 is disposed with a radial clearance (gap) from the inner peripheral surface of the motor stator 21.

The oil pump 30 is provided in the first pump housing 13 and the second pump housing 14. That is, the oil pump 30 is provided at a position on the first side in the axial direction (side A) with respect to the position of the electric motor 20 so as to be adjacent to the electric motor 20.

For example, an internal gear pump (such as a trochoid pump) is applied to the oil pump 30. The oil pump 30 includes a housing chamber 31, an inner rotor 32, an outer rotor 33, a suction port 34, a discharge port 35, an inlet passage 36, and an outlet passage 37.

The housing chamber 31 is a cylindrical space formed (i.e., defined) by the first pump housing 13 and the second pump housing 14. A central axis of the cylindrical inner peripheral surface of the housing chamber 31 is offset from a rotation axis of the motor rotor 22 of the electric motor 20.

The inner rotor 32 (corresponding to a pump rotational element) and the outer rotor 33 are rotatably housed in the housing chamber 31. The inner rotor 32 has a ring shape with external teeth on its outer peripheral surface. The outer rotor 33 has a ring shape with internal teeth on its inner peripheral surface. The internal teeth mesh with the external teeth of the inner rotor 32. The outer peripheral surface of the outer rotor 33 has a cylindrical shape conforming to the cylindrical inner peripheral surface of the housing chamber 31. The outer rotor 33 rotates coaxially with the central axis of the cylindrical inner peripheral surface of the housing chamber 31. The inner rotor 32 is rotatable coaxially with the rotation axis of the motor rotor 22 of the electric motor 20. That is, the rotation axes of the inner rotor 32 and the outer rotor 33 are offset from each other.

The external teeth of the inner rotor 32 and the internal teeth of the outer rotor 33 mesh with each other at a plurality of points in a circumferential direction. Thus, a plurality of pump chambers 38 is formed at positions adjacent to each other in the circumferential direction in a radial clearance between the external teeth of the inner rotor 32 and the internal teeth of the outer rotor 33. When the inner rotor 32 and the outer rotor 33 rotate in the housing chamber 31 while the external teeth of the inner rotor 32 and the internal teeth of the outer rotor 33 mesh with each other, the volumes of the pump chambers 38 decrease and the oil pressure increases.

In the pump housings 13 and 14, the suction port 34 and the discharge port 35 that communicate with the housing chamber 31 are formed on the side A (first side) or the side B (second side) in the axial direction (i.e., on one side of the side A (first side) and the side B (second side) in the axial direction) with respect to the positions of the inner rotor 32 and the outer rotor 33. In this example, the suction port 34 and the discharge port 35 are formed in the second pump housing 14, and are open to the axial end face of the cylindrical space of the housing chamber 31. That is, the suction port 34 and the discharge port 35 are formed on the side A (first side), that is, the side opposite to the electric motor 20 with respect to the positions of the inner rotor 32 and the outer rotor 33.

The suction port 34 and the discharge port 35 are shifted in the circumferential direction. The inlet passage 36 that communicates with the suction port 34 is formed in the second pump housing 14 having the suction port 34. The outlet passage 37 that communicates with the discharge port 35 is formed in the second pump housing 14 having the discharge port 35. The suction port 34, the discharge port 35, the inlet passage 36, and the outlet passage 37 may be formed in the first pump housing 13. In view of the space, the ports 34 and 35 and the passages 36 and 37 are formed more easily on the side where the electric motor 20 is not disposed, that is, in the second pump housing 14.

The pump chambers 38 are supplied with oil sucked via the inlet passage 36 and the suction port 34. The oil whose pressure is increased in the pump chambers 38 is discharged to the outside via the discharge port 35 and the outlet passage 37.

The motor rotor 22 of the electric motor 20 and the inner rotor 32 of the oil pump 30 serving as the pump rotational element are fitted to the shaft 40 so as to be rotatable together with the shaft 40. Specifically, the shaft 40 is fitted to the central hole of the motor rotor 22. In this example, the shaft 40 and the motor rotor 22 are fixed by press fitting. The shaft 40 is also fitted to the central hole of the inner rotor 32 of the oil pump 30. The shaft 40 and the inner rotor 32 are rotatable together by a fixing method different from press fitting.

The shaft 40 is rotatably supported on the housing 10. A rotation axis of the shaft 40 coincides with the rotation axis of the motor rotor 22 and the rotation axis of the inner rotor 32 of the oil pump 30.

The electric oil pump apparatus 1 further includes a first bearing 51 and a second bearing 52 to support the shaft 40 while allowing rotation of the shaft 40 relative to the housing 10. The first bearing 51 and the second bearing 52 are radial bearings. A plain bearing or a rolling bearing may be employed as each of the first bearing 51 and the second bearing 52. Details of a support structure for the shaft 40 are described later.

The electric oil pump apparatus 1 further includes a sealing member 60. The sealing member 60 is provided between the housing chamber 31 of the oil pump 30 and the area where the electric motor 20 is disposed, and prevents the oil in the housing chamber 31 from flowing toward the electric motor 20. The sealing member 60 is disposed on the inner peripheral surface of the first pump housing 13 at a position on the side B, that is, the electric motor 20-side, and is in contact with the outer peripheral surface of the shaft 40.

The electric oil pump apparatus 1 further includes a control board 70. The control board 70 may be disposed outside the electric oil pump apparatus 1 instead of being disposed in the unit of the electric oil pump apparatus 1. The control board 70 has a control circuit configured to control the electric motor 20. The control board 70 is disposed in a space formed (i.e., defined) by the first motor housing 11 and the second motor housing 12. Specifically, the control board 70 is disposed on the side B (upper side in FIG. 1) with respect to the position of the electric motor 20.

3. Detailed Structure of Shaft 40

The detailed structure of the shaft 40 is described with reference to FIG. 1. The shaft 40 has a first bearing surface 41, a rotation transmission surface 42, a second bearing surface 43, a sealing surface 44, and a motor rotor fixing surface 45 in the stated order from the end on the side A to the side B (upper side in FIG. 1) in the axial direction. The first bearing surface 41, the second bearing surface 43, the sealing surface 44, and the motor rotor fixing surface 45 are cylindrical outer peripheral surfaces. In this example, the first bearing surface 41, the second bearing surface 43, the sealing surface 44, and the motor rotor fixing surface 45 have the same outside diameter, but may have different outside diameters.

The first bearing surface 41 is supported by the first bearing 51. When the first bearing 51 is a plain bearing, the first bearing 51 slides relative to the first bearing surface 41. When the first bearing 51 is a rolling bearing, an inner ring of the first bearing 51 is fixed to the first bearing surface 41.

The rotation transmission surface 42 is configured to transmit a rotational force (torque) between the rotation transmission surface 42 and the inner rotor 32 (pump rotational element) of the oil pump 30. In this example, the rotation transmission surface 42 has a male spline (i.e., an external spline). The male spline is shaped to protrude in a radial direction. The rotation transmission surface 42 has a first stepped portion 42*a* and a second stepped portion 42*b* respectively located on both axial end faces of the male spline. Each of the first stepped portion 42*a* and the second stepped portion 42*b* has a difference in the outside diameter. The first stepped portion 42*a* is an end face of the male spline, which is located on the side A (lower side in FIG. 2). The second stepped portion 42*b* is an end face of the male spline, which is located on the side B (upper side in FIG. 2). In this example, the first stepped portion 42*a* and the second stepped portion 42*b*, which are respectively located on both the axial end faces of the male spline, are formed to be inclined faces.

The second bearing surface 43 is supported by the second bearing 52. When the second bearing 52 is a plain bearing, the second bearing 52 slides relative to the second bearing surface 43. When the second bearing 52 is a rolling bearing, an inner ring of the second bearing 52 is fixed to the second bearing surface 43.

The sealing member 60 slides relative to the sealing surface 44. The motor rotor 22 is fitted to the motor rotor fixing surface 45. In this example, the motor rotor 22 is press-fitted to the motor rotor fixing surface 45. That is, the motor rotor 22 is fitted to the motor rotor fixing surface 45 with a radial interference.

The shaft 40 is supported on the housing 10 only at two positions, that is, by the first bearing 51 and the second bearing 52. That is, the shaft 40 is rotatably supported on the housing 10 at the positions on both the side A (first side; lower side in FIG. 1) and the side B (second side; upper side in FIG. 1) in the axial direction with respect to the position of the inner rotor 32 of the oil pump 30, the inner rotor 32 serving as the pump rotational element.

Since the shaft 40 is supported on the housing 10 only at the two positions described above, the shaft 40 has a free end (i.e., a free end side) located on the side B (upper side in FIG. 1) with respect to the second bearing surface 43, that is, a free end side that is closer to the electric motor 20 than the second bearing surface 43 is. In other words, the motor rotor 22 is fixed to the free end side of the shaft 40 with respect to the second bearing surface 43.

4. Structure of Support Surfaces of Housing 10

Next, the structure of support surfaces of the housing 10 is described in more detail with reference to FIG. 2. The first bearing 51 and the second bearing 52 are supported on the pump housings 13 and 14 of the housing 10.

Figure 2:
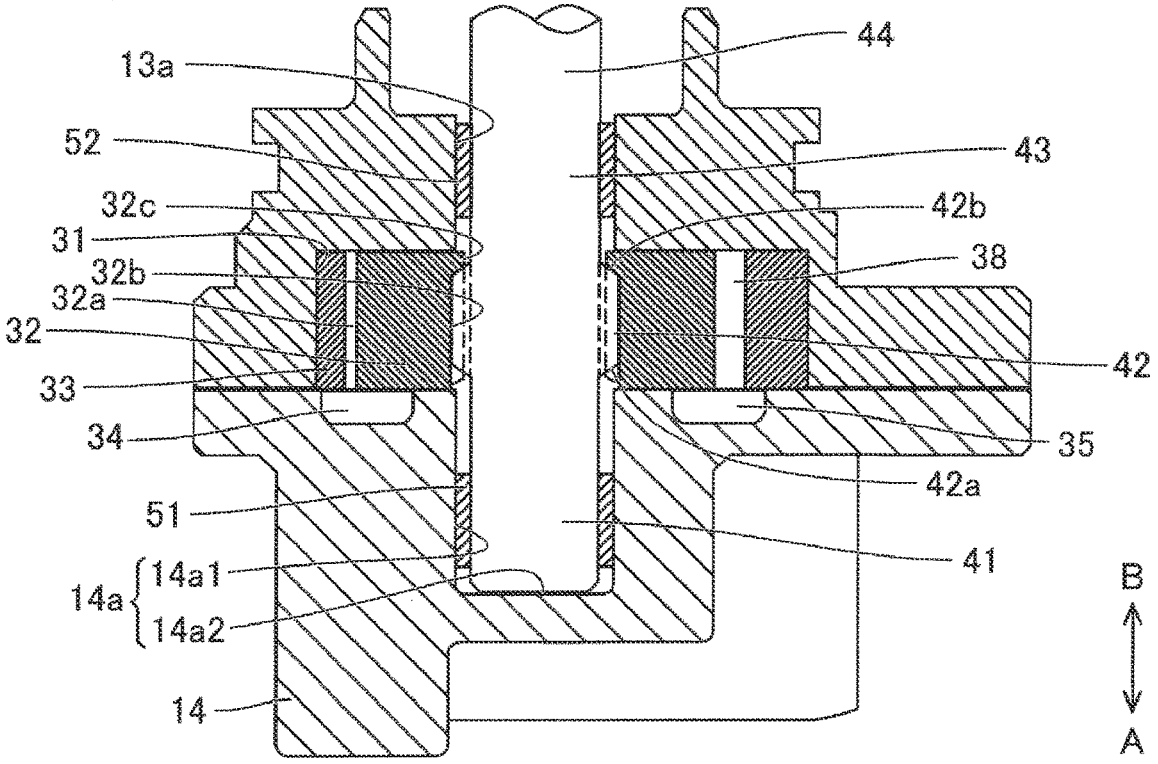
FIG. 2 is an axial sectional view of a unit of an oil pump in the electric oil pump apparatus.

As illustrated in FIG. 1 and FIG. 2, the second pump housing 14 has the suction port 34, the discharge port 35, the inlet passage 36, and the outlet passage 37. These ports and passages are formed at positions offset in the radial direction from the rotation axis of the inner rotor 32 of the oil pump 30.

The second pump housing 14 has a central recess 14*a*. The central recess 14*a* is located in an area where the suction port 34, the discharge port 35, the inlet passage 36, and the outlet passage 37 are not formed. The central recess 14*a* is open to the housing chamber 31, and has a cylindrical inner peripheral surface 14*a*1 and a circular bottom face 14*a*2. The central recess 14*a* is disposed at a position including the rotation axis of the inner rotor 32 (pump rotational element) of the oil pump 30. The cylindrical inner peripheral surface 14*al* of the central recess 14*a* is coaxial with the inner rotor 32. The first bearing surface 41 that is a part of the shaft 40 is disposed in the central recess 14*a*.

The first bearing 51 is fitted to the cylindrical inner peripheral surface 14*al* of the central recess 14*a*. In this example, the first bearing 51 is press-fitted to the cylindrical inner peripheral surface 14*al* of the central recess 14*a*. That is, the cylindrical inner peripheral surface 14*al* of the central recess 14*a* serves as a first radial support surface for the shaft 40.

The end face of the shaft 40, which is located on the side A (lower side in FIG. 2), may be in contact with the circular bottom face 14*a*2 of the central recess 14*a*. The circular bottom face 14*a*2 of the central recess 14*a* may be in contact with the end face of the shaft 40, or oil may be provided between the circular bottom face 14*a*2 and the end face of the shaft 40 such that the circular bottom face 14*a*2 is not in direct contact with the end face of the shaft 40. That is, the circular bottom face 14*a*2 of the central recess 14*a* serves as a first thrust support surface that engages with a portion of the shaft 40, which is located on the side A (first side) in the axial direction. The circular bottom face 14*a*2 of the central recess 14*a* also serves as a restriction surface that restricts axial movement of the shaft 40 away from the electric motor 20 (i.e., axial movement of the shaft 40 toward the side A).

The first pump housing 13 has a cylindrical inner peripheral surface 13*a* between the housing chamber 31 and the support position for the sealing member 60 in the axial direction. The cylindrical inner peripheral surface 13*a* is coaxial with the inner rotor 32. The second bearing 52 is fitted to the cylindrical inner peripheral surface 13*a*. In this example, the second bearing 52 is press-fitted to the cylindrical inner peripheral surface 13*a*. That is, the cylindrical inner peripheral surface 13*a* serves as a second radial support surface for the shaft 40.

5. Detailed Structure of Inner Rotor 32 of Oil Pump 30

Next, the detailed structure of the inner rotor 32 (pump rotational element) of the oil pump 30 is described with reference to FIG. 2. The inner rotor 32 has external teeth 32*a* on its outer peripheral surface. For example, the external teeth 32*a* are shaped by a trochoid curve. The inner rotor 32 has a rotation transmission surface 32*b* in its inner peripheral surface. The rotation transmission surface 32*b* is configured to transmit a rotational force (torque) between the rotation transmission surface 32*b* and the rotation transmission surface 42 of the shaft 40. In this example, the rotation transmission surface 32*b* of the inner rotor 32 has a female spline (i.e., an internal spline), which is fitted to the male spline of the rotation transmission surface 42 of the shaft 40.

The inner rotor 32 has an engagement portion 32*c* at an end of the female spline of the rotation transmission surface 32*b*, the end being located on the side B. The engagement portion 32*c* is a wall formed at the end of the female spline, which is located on the side B, and at a position along a circumferential direction of grooves of the female spline. The engagement portion 32*c* of the inner rotor 32 engages in the axial direction with the second stepped portion 42*b* (axial end face) of the male spline of the rotation transmission surface 42 of the shaft 40.

That is, the engagement portion 32*c* of the inner rotor 32 serves as a second thrust support surface that engages with a portion of the shaft 40, which is located on the side B (second side) in the axial direction. The engagement portion 32*c* of the inner rotor 32 also serves as a restriction surface that restricts axial movement of the shaft 40 toward the electric motor 20 (side B).

6. Structure for Bearing Radial Load of Shaft 40

A structure for bearing a radial load of the shaft 40 is described with reference to FIG. 1 and FIG. 2. As described above, the shaft 40 is supported by the first bearing 51 and the second bearing 52 that are radial bearings so as to be rotatable relative to the housing 10.

The shaft 40 is rotatably supported on the second pump housing 14 via the first bearing 51 located on the side A (first side; lower side in FIG. 2) with respect to the position of the inner rotor 32 of the oil pump 30, which serves as the pump rotational element. Further, the shaft 40 is rotatably supported on the first pump housing 13 via the second bearing 52 located on the side B (second side; upper side in FIG. 2) with respect to the position of the inner rotor 32 such that second bearing 52 is located between the inner rotor 32 and the electric motor 20 in the axial direction.

That is, the shaft 40 is supported on the housing 10 by the first bearing 51 and the second bearing 52 that are respectively located on both sides in the axial direction with respect to the inner rotor 32 of the oil pump 30, which serves as the pump rotational element. Thus, even if a radial force is applied to the shaft 40 due to high-pressure oil, tilting of the shaft 40 can be restrained at the position of the oil pump 30. Since the tilting of the shaft 40 is restrained, tilting of the inner rotor 32 serving as the pump rotational element fixed to the shaft 40 is restrained. Since the tilting of the inner rotor 32 serving as the pump rotational element can be restrained, the pump chambers 38 can be kept in a desired state. Thus, the pump performance and the pump durability can be improved.

It is desirable that the shaft 40 be supported at two axial positions. Since the shaft 40 is supported by the first bearing 51 and the second bearing 52 as described above, the shaft 40 has a free end (i.e., a free end side) that is closer to the electric motor 20 than the second bearing 52 is. The motor rotor 22 of the electric motor 20 is fixed to the free end side of the shaft 40.

As the force for tilting the shaft 40, the force caused by the high-pressure oil in the oil pump 30 is greater than a force caused by the electric motor 20. Since the tilting of the shaft 40 is restrained at the position of the oil pump 30, the tilting of the free end side of the shaft 40 is also restrained at the position of the electric motor 20.

The first bearing 51 is disposed in the central recess 14*a* of the second pump housing 14. The second pump housing 14 has the suction port 34, the discharge port 35, the inlet passage 36, and the outlet passage 37, and the central recess 14*a* is formed in the area where the ports 34 and 35 and the passages 36 and 37 cannot be formed. Since the area that may be a dead space is used as the central recess 14*a*, the support structure for the shaft 40 can be secured without increasing the size of the housing 10.

In this example, the electric oil pump apparatus 1 includes the control board 70 disposed on the side B (upper side in FIG. 1) with respect to the electric motor 20. The first bearing 51 and the second bearing 52 are located on the oil pump 30-side with respect to the electric motor 20 (i.e., the first bearing 51 and the second bearing 52 are closer to the oil pump 30 than the electric motor 20 is), and no bearing is disposed on the control board 70-side with respect to the electric motor 20 (i.e., there is no bearing that is disposed closer to the control board 70 than the electric motor 20 is). Therefore, a wide space can be secured between the electric motor 20 and the control board 70. As a result, a large electronic component can be disposed on the control board 70 without increasing the size of the housing 10.

7. Structure for Bearing Thrust Load of Shaft 40

A structure for bearing a thrust load of the shaft 40 is described with reference to FIG. 2. As described above, the circular bottom face 14*a*2 of the central recess 14*a* restricts the axial movement of the shaft 40 away from the electric motor 20, and the engagement portion 32*c* restricts the axial movement of the shaft 40 toward the electric motor 20. Thus, the axial movement of the shaft 40 is restricted on both sides in the axial direction.

In particular, the axial movement of the shaft 40 is restricted near the inner rotor 32 of the oil pump 30, which serves as the pump rotational element. Thus, the shaft 40 is stably positioned at the oil pump 30.

The circular bottom face 14*a*2 of the central recess 14*a* and the engagement portion 32*c* restrict the axial movement of the shaft 40 on both sides in the axial direction. That is, there is no need to provide a large interference between the male spline of the rotation transmission surface 42 of the shaft 40 and the female spline of the rotation transmission surface 32*b* of the inner rotor 32.

In general, the shaft 40 and the inner rotor 32 may be fixed by press fitting. When the shaft 40 and the inner rotor 32 are fixed by press fitting, however, the contour of the inner rotor 32 bulges slightly. That is, the external teeth 32*a* of the inner rotor 32 are deformed. Due to the deformation of the external teeth 32*a* of the inner rotor 32, the meshing state between the external teeth 32*a* of the inner rotor 32 and the internal teeth of the outer rotor 33 changes slightly. Thus, the pump performance may be affected.

In this example, the shaft 40 and the inner rotor 32 need not be fixed by press fitting. The circular bottom face 14*a*2 of the central recess 14*a* and the engagement portion 32*c* restrict the axial movement of the shaft 40 and the inner rotor 32 on both sides in the axial direction. Therefore, the rotation transmission surface 42 of the shaft 40 and the rotation transmission surface 32*b* of the inner rotor 32 need not be fixed by press fitting, and are fitted to each other so as to transmit a rotational force (torque). Thus, the deformation of the external teeth 32*a* of the inner rotor 32 can be restrained. As a result, the pump performance can be improved. This structure also contributes to improvement in the pump durability.

8. Kinds of Bearings

Next, description is provided on kinds of the first bearing 51 and the second bearing 52. Both a plain bearing and a rolling bearing may be employed as each of the first bearing 51 and the second bearing 52 as long as the first bearing 51 and the second bearing 52 are radial bearings. It is desirable that plain bearings be employed as the first bearing 51 and the second bearing 52.

The first bearing 51 is disposed in the central recess 14*a*. In general, the plain bearing has a smaller radial thickness than that of the rolling bearing. It is not easy to secure a sufficient space for the central recess 14*a* due to surrounding environments, that is, the ports 34 and 35 and the passages 36 and 37. By applying the plain bearing to the first bearing 51, the pump housings 13 and 14 can be downsized.

The second bearing 52 is fitted to a portion of the inner peripheral surface of the first pump housing 13, the portion of the first pump housing 13 being located on the electric motor 20-side (side B). The portion of the first pump housing 13, which is located on the electric motor 20-side, is fitted to the inner peripheral surface of the first motor housing 11. If the outside diameter of the second bearing 52 increases, the outside diameter of the first motor housing 11 increases as well. By employing the plain bearing as the second bearing 52, the first motor housing 11 can be downsized.

The first bearing 51 and the second bearing 52 are provided at portions that the oil in the oil pump 30 enters. Thus, the sliding resistance between the first bearing 51 and the shaft 40 and the sliding resistance between the second bearing 52 and the shaft 40 can be reduced sufficiently.

Since the second bearing 52 is located between the electric motor 20 and the oil pump 30 in the axial direction, the rolling bearing may be employed as the second bearing 52 when a space can be secured without increasing the size of the first motor housing 11. Similarly, the rolling bearing may be employed as the first bearing 51 when a space can be secured. When only one of the first bearing 51 and the second bearing 52 is the plain bearing, the plain bearing may be employed as a bearing on the side where the ports 34 and 35 and the passages 36 and 37 are located, that is, the first bearing 51.

What is claimed is:

1. An electric oil pump apparatus comprising:

a housing;

an electric motor housed in the housing and including a motor stator and a motor rotor;

an oil pump provided in the housing adjacent to the electric motor in an axial direction, the oil pump including a pump rotational element that is rotatable coaxially with the motor rotor and a female spline with an engagement portion at an end of the female spline that extends radially inward;

a shaft to which the motor rotor and the pump rotational element are fitted such that the motor rotor and the pump rotational element are rotatable together with the shaft, the shaft including a male spline that engages with the female spline, the male spline including a stepped portion on an axial end face of the male spline, the stepped portion having an outside diameter less than an outside diameter of a central portion of the male spline, and the stepped portion engages with the engagement portion in the axial direction to restrict axial movement of the shaft toward the electric motor, the stepped portion and the engagement portion being disposed on a second side in the axial direction with respect to a position of the pump rotational element the second side being opposite to a first side with respect to the position of the pump rotational element;

a first bearing disposed on the first side in the axial direction with respect to the position of the pump rotational element, the first bearing supporting the shaft while allowing rotation of the shaft relative to the housing; and a second bearing disposed on the second side in the axial direction with respect to the position of the pump rotational element and the second bearing supporting the shaft while allowing the rotation of the shaft relative to the housing, wherein the housing includes a central recess in which the shaft is at least partially located, the central recess including a bottom face on the first side that restricts movement of the shaft in the axial direction away from the electric motor, and the engagement portion extends into the central recess in a radial direction on a side of the pump rotational element toward the electric motor in the axial direction.

2. The electric oil pump apparatus according to claim 1, wherein:

the first bearing is disposed on the first side in the axial direction that is a side opposite to the electric motor, with respect to the position of the pump rotational element;

the second bearing is disposed on the second side in the axial direction that is a side where the electric motor is located, with respect to the position of the pump rotational element, the second bearing being located between the pump rotational element and the electric motor; and the shaft has a free end side that is closer to the electric motor than the second bearing is, and the motor rotor is fixed to the free end side of the shaft with respect to the second bearing.

3. The electric oil pump apparatus according to claim 1, wherein at least one of the first bearing and the second bearing is a plain bearing.

4. The electric oil pump apparatus according to claim 3, wherein:

the oil pump has a suction port and a discharge port that are located on one side of the first side and the second side in the axial direction with respect to the position of the pump rotational element; and at least the one of the first bearing and the second bearing is the plain bearing, the one of the first bearing and the second bearing being located on the one side where the suction port and the discharge port are located.

5. The electric oil pump apparatus according to claim 4, wherein:

the central recess is coaxial with the pump rotational element at a position including a rotation axis of the pump rotational element, the central recess being provided on the one side where the suction port and the discharge port are located in the axial direction with respect to the position of the pump rotational element; and the one of the first bearing and the second bearing is the plain bearing that is disposed in the central recess to support the part of the shaft that is located in the central recess.

6. The electric oil pump apparatus according to claim 3, wherein each of the first bearing and the second bearing is the plain bearing.

7. The electric oil pump apparatus according to claim 1, wherein:

the first bearing and the second bearing are each plain bearings that are disposed in the central recess of the housing; and the engagement portion supports a thrust load of the shaft.

* * * * *